US010539362B2

(12) United States Patent
Imamkhan

(10) Patent No.: US 10,539,362 B2
(45) Date of Patent: Jan. 21, 2020

(54) METHOD AND SYSTEM FOR PRODUCING A PRESSURIZED AND AT LEAST PARTIALLY CONDENSED MIXTURE OF HYDROCARBONS

(71) Applicant: SHELL OIL COMPANY, Houston, TX (US)

(72) Inventor: Brian Reza Shaied Shehdjiet Imamkhan, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 439 days.

(21) Appl. No.: 15/317,819

(22) PCT Filed: Jun. 9, 2015

(86) PCT No.: PCT/EP2015/062840

§ 371 (c)(1),
(2) Date: Dec. 9, 2016

(87) PCT Pub. No.: WO2015/189210

PCT Pub. Date: Dec. 17, 2015

(65) Prior Publication Data

US 2017/0131026 A1 May 11, 2017

Related U.S. Application Data

(60) Provisional application No. 62/010,893, filed on Jun. 11, 2014.

(30) Foreign Application Priority Data

Jun. 17, 2014 (EP) ..... 14172745

(51) Int. Cl.
*F25J 1/02* (2006.01)
*F25J 1/00* (2006.01)
(Continued)

(52) U.S. Cl.
CPC ..... *F25J 1/0022* (2013.01); *C10G 5/06* (2013.01); *F25B 1/10* (2013.01); *F25B 40/04* (2013.01);
(Continued)

(58) Field of Classification Search
CPC ..... F25J 1/0298; F25J 1/0279; F25J 1/0296; F25J 1/0022; F25B 2400/0405
See application file for complete search history.

(56) References Cited

U.S. PATENT DOCUMENTS 4,156,578 A 5/1979 Agar et al.
4,230,437 A 10/1980 Bellinger et al.
(Continued)

FOREIGN PATENT DOCUMENTS

CN 103216998 7/2013
EP 2426452 3/2012
(Continued)

OTHER PUBLICATIONS

Sulzer Chemtech, "Mixing and Reaction Technology; Pace-setting technology, worldwide", 23.27.06.40-III.13-10—Printed in Switzerland, www.sulzer.com, 20 pages.
(Continued)

*Primary Examiner* — Devon Russell

(57) ABSTRACT

A mixture of hydrocarbons in vapour phase is passed through a feed scrubber. Feed scrubber vapour discharged from the feed scrubber is passed to a compression suction scrubber, and a vaporous compressor feed stream from the compression suction scrubber is compressed in a compressor train. A compressed vaporous discharge stream from the train of compressors is de-superheated, and at least a portion of the de-superheated stream is passed to a condenser, wherein this portion of the de-superheated stream is at least partly condensed to form a pressurized and at least partially
(Continued)

Figure 1:
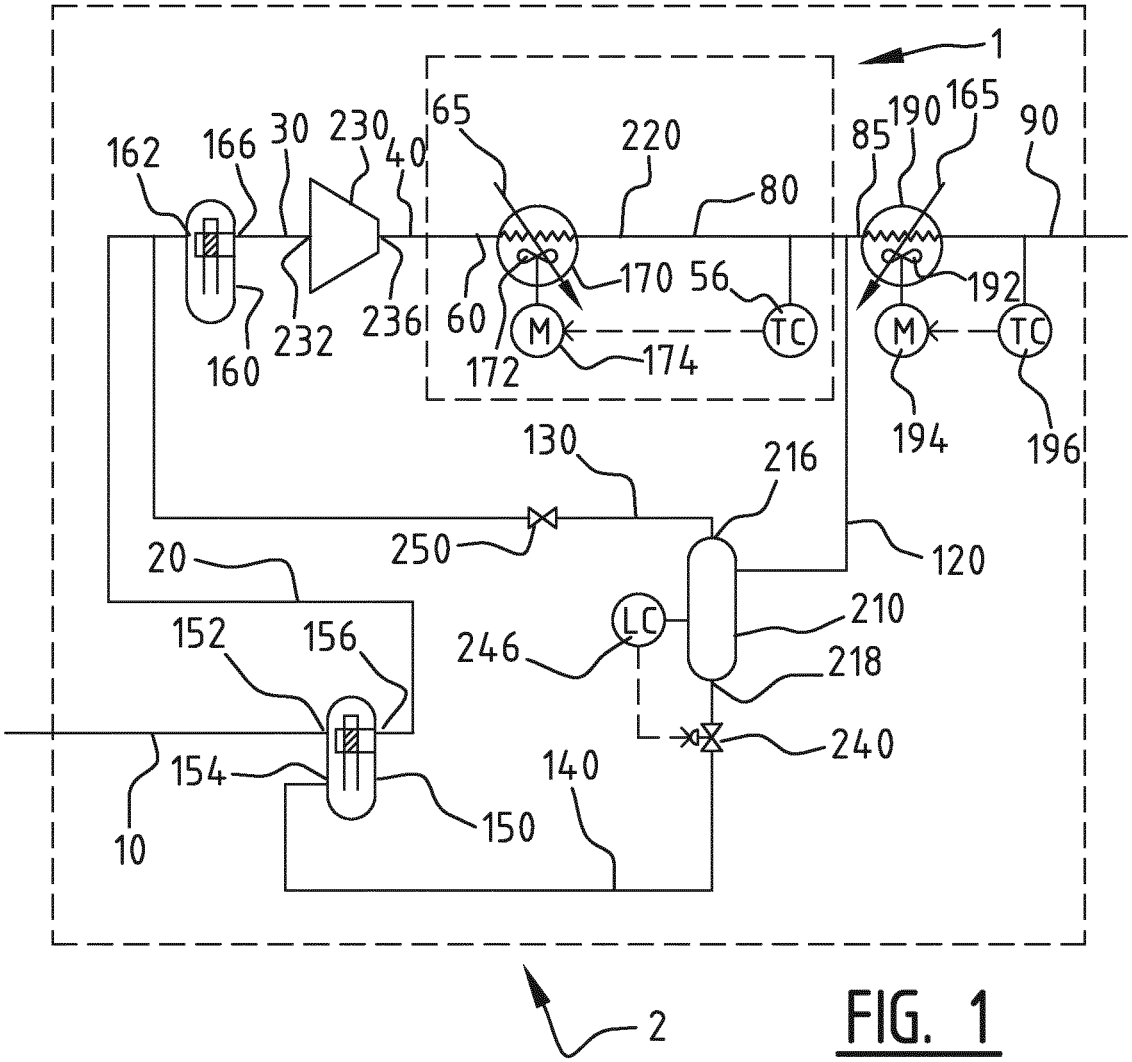

condensed mixture of hydrocarbons. A recycle portion is split off from the de-superheated hydrocarbon stream, and a recycle flow is established to the compressor train of via a surge recycle separator drum and the compression suction scrubber. Liquid constituents removed and drained from the recycle portion in the surge recycle separator drum are fed to the feed scrubber.

15 Claims, 2 Drawing Sheets

(51) Int. Cl.

| | |
|---|---|
| ***C10G 5/06*** | (2006.01) |
| ***F25B 1/10*** | (2006.01) |
| ***F25B 40/04*** | (2006.01) |
| ***F25B 49/02*** | (2006.01) |

(52) U.S. Cl.

CPC ..... *F25B 49/02* (2013.01); *F25J 1/0052* (2013.01); *F25J 1/0055* (2013.01); *F25J 1/0279* (2013.01); *F25J 1/0292* (2013.01); *F25J 1/0296* (2013.01); *F25J 1/0298* (2013.01); *F25B 2400/0405* (2013.01); *F25B 2400/072* (2013.01); *F25B 2400/23* (2013.01); *F25B 2600/111* (2013.01); *F25B 2600/19* (2013.01); *F25B 2600/2501* (2013.01); *F25B 2600/2509* (2013.01); *F25B 2700/21162* (2013.01)

(56) References Cited

U.S. PATENT DOCUMENTS

| | | | | |
|---|---|---|---|---|
| 4,921,399 | A * | 5/1990 | Lew | F04D 27/0207 415/1 |
| 5,421,165 | A | 6/1995 | Paradowski et al. | |
| 5,893,274 | A | 4/1999 | Nagelvoort et al. | |
| 5,946,925 | A * | 9/1999 | Williams | F25B 41/04 62/196.3 |
| 6,014,869 | A | 1/2000 | Elion et al. | |
| 6,105,391 | A | 8/2000 | Capron | |
| 6,332,336 | B1 | 12/2001 | Mirsky et al. | |
| 6,631,626 | B1 | 10/2003 | Hahn | |
| 7,069,733 | B2 | 7/2006 | Lucas et al. | |
| 8,532,830 | B2 | 9/2013 | Van Dijk | |
| 10,309,719 | B2 * | 6/2019 | Imamkhan | F04D 27/0238 |
| 2004/0065113 | A1 * | 4/2004 | Paradowski | F25J 1/0022 62/613 |
| 2005/0022552 | A1 * | 2/2005 | Lucas | F04D 27/0207 62/613 |
| 2007/0204649 | A1 * | 9/2007 | Kaart | F04D 27/0207 62/612 |
| 2008/0066492 | A1 * | 3/2008 | Buijs | F25J 3/0209 62/612 |
| 2011/0126584 | A1 | 6/2011 | Van Dijk | |
| 2011/0277498 | A1 * | 11/2011 | Kaart | F04D 27/0207 62/613 |
| 2012/0121376 | A1 * | 5/2012 | Huis In Het Veld | F04D 27/0207 415/1 |
| 2012/0261092 | A1 * | 10/2012 | Heath | F25B 1/10 165/96 |

FOREIGN PATENT DOCUMENTS

| | | |
|---|---|---|
| WO | WO2008019999 | 2/2008 |
| WO | WO2008136884 | 11/2008 |
| WO | WO2009050178 | 4/2009 |

OTHER PUBLICATIONS

Key, Bill et al., "Constraints complicate centrifugal compressor depressurization", 492 Oil & Gas Journal, 91(1993) May 10, No. 19, Tulsa, OK, US, pp. 50-54.

Perez, Victor et al., "The 4.5 MMTPA LNG Train—A Cost Effective Design", Twelfth International Conference on Liquefied Natural Gas,1998, 3.7 pp. 1-15.

S. Jamaludin et al., "Process Understanding and Control Approach of Separator Column coupled with Overhead Compressor: Lessons learnt from Malaysia LNG Tiga", Natural Gas Utilization Topical Conference 2005, Apr. 10-14, 2005, Atlanta, Georgia, US, pp. 271-280.

* cited by examiner

METHOD AND SYSTEM FOR PRODUCING A PRESSURIZED AND AT LEAST PARTIALLY CONDENSED MIXTURE OF HYDROCARBONS

CROSS-REFERENCE TO RELATED APPLICATIONS

The present application is a National Stage (§ 371) application of PCT/EP2015/062840, filed Jun. 9, 2015, which claims the benefit of European Application No. 14172745.3, filed Jun. 17, 2014, and also claims benefit of U.S. Provisional Application No. 62/010,893, filed Jun. 11, 2014, which is incorporated herein by reference in its entirety.

The present invention relates to a method of producing a pressurized and at least partially condensed mixture of hydrocarbons. In another aspect, the present invention relates to a compression system for producing a pressurized and at least partially condensed mixture of hydrocarbons.

A pressurized and at least partially condensed mixture of hydrocarbons is frequently produced in refrigeration cycles, wherein the pressurized and at least partially condensed mixture of hydrocarbons is typically expanded and brought into indirect heat exchanging contact with a product stream to extract heat from the product stream. In such application, the mixture of hydrocarbons is typically referred to a mixed refrigerant (MR) or mixed component refrigerant (MCR).

An example of a single mixed refrigerant cycle is disclosed in CN103216998A. The method in this example comprises the steps of performing compressor first-section compression and inter-cooling on the mixed refrigerant; then, entering a second section and a third section for continuous compression; then, cooling the mixed refrigerant in two steps, and forming a gas phase and a liquid phase in last-step cooling. The temperature of the de-superheated mixed refrigerant between the first-step cooling and last step cooling is between 65 and 100° C., and the temperature of the gas phase and liquid phase after the last-step cooling is between 20 and 50° C. A compression suction pot is provided at the suction inlet of the compressor train.

Anti-surge lines are provided to recycle a portion of the de-superheated mixed refrigerant from between the first-step cooling and last-step cooling to the compression suction pot.

The system and method of CN103216998A may not be suitable when an ambient stream, particularly an ambient air stream, is used as the cooling stream. Ambient water streams, and ambient air streams more so, are subject to relatively large and unpredictable temperature variations and variations in humidity (in case of air). Hence, in order to guarantee that the de-superheated mixed refrigerant between the first-step cooling and last step cooling is fully vaporous, a relatively large margin needs to be observed between the target temperature of the de-superheated mixed refrigerant between the first-step cooling and last step cooling and the dew point of the mixed refrigerant between the first-step cooling and last step cooling.

In one aspect, the invention provides a method of producing a pressurized and at least partially condensed mixture of hydrocarbons, comprising:

providing a mixture of hydrocarbons in vapour phase and passing said mixture of hydrocarbons through a feed scrubber comprising a feed drum whereby discharging a feed scrubber vapour from the feed scrubber;

passing the feed scrubber vapour from the feed scrubber through a compression suction scrubber comprising a suction drum whereby discharging a vaporous compressor feed stream from the compression suction scrubber;

compressing the vaporous compressor feed stream in a train of one or more compressors to a higher pressure whereby forming a compressed vaporous discharge stream;

de-superheating the compressed vaporous discharge stream in a de-superheater system comprising a de-superheater heat exchanger, comprising bringing at least a portion of the compressed vaporous discharge stream in indirect heat exchanging contact with an ambient stream in the de-superheater heat exchanger, whereby allowing heat to flow from the compressed vaporous discharge stream to the ambient stream, thereby forming a de-superheated hydrocarbon stream out of the compressed vaporous discharge stream;

passing at least a portion of the de-superheated hydrocarbon stream from the de-superheater system to a condenser via a de-superheater discharge conduit and further cooling the portion of the de-superheated hydrocarbon stream in said condenser by indirect heat exchanging said portion of the de-superheated hydrocarbon stream against a cooling stream, whereby said portion of the de-superheated hydrocarbon stream is at least partly condensed to form the pressurized and at least partially condensed mixture of hydrocarbons;

splitting off a recycle portion from the de-superheated hydrocarbon stream in the de-superheater discharge conduit and establishing a recycle flow at a recycle flow rate from the de-superheater discharge conduit to the train of one or more compressors via a surge recycle separator drum, a surge recycle valve, and the compression suction scrubber, whereby controlling the recycle flow rate with the surge recycle valve and removing and draining liquid constituents from the recycle portion of the de-superheated hydrocarbon stream via a liquid drain outlet provided in the surge recycle separator drum;

feeding the liquid constituents drained from the recycle portion of the de-superheated hydrocarbon stream to the feed scrubber.

According to an embodiment, the de-superheater system comprise a de-superheater bypass line to selectively bypass the de-superheater heat exchanger, the de-superheater bypass line comprising a temperature controlled valve, and a temperature controller functionally coupled to the temperature-controlled valve, and the method comprises changing a valve opening setting in response to a temperature of de-superheated stream in the de-superheater discharge conduit.

Controlling the recycle flow rate is done to maintain a flow rate through the train of one or more compressors to keep the train of one or more compressors from surging. This may for instance be done by known surge control techniques, such as including measuring the flow rate through the train of one or more compressors and monitoring the operation of the train of one or more compressors and controlling the recycle flow rate in response thereto.

In another aspect, the invention provides a compression system for producing a pressurized and at least partially condensed mixture of hydrocarbons, comprising:

a feed scrubber comprising a feed drum provided with at least a feed scrubber inlet connected to a feed vapour source providing a mixture of hydrocarbons in vapour phase, and with a feed scrubber vapour outlet;

a compression suction scrubber comprising a suction drum provided with at least a suction scrubber inlet fluidly connected to the feed scrubber vapour outlet, and with a suction scrubber outlet configured to discharge a vaporous compressor feed stream from the compression suction scrubber;

a train of one or more compressors, comprising a suction inlet fluidly connected to the feed scrubber vapour outlet, and a compressor train discharge outlet, which train is configured to compress the vaporous compressor feed stream from the compression suction scrubber to a higher pressure whereby forming a compressed vaporous discharge stream at the discharge outlet;

a de-superheater system configured to form a de-superheated hydrocarbon stream out of the compressed vaporous discharge stream, said de-superheater system comprising a de-superheater heat exchanger arranged in fluid communication with the compressor train discharge outlet, wherein said de-superheater system is configured to bring at least a portion of the compressed vaporous discharge stream in indirect heat exchanging contact with an ambient stream in the de-superheater heat exchanger, whereby allowing heat to flow from the compressed vaporous discharge stream to the ambient stream;

a condenser arranged to receive at least a portion of the de-superheated hydrocarbon stream and configured to further cool the portion of the de-superheated hydrocarbon stream by allowing indirect heat exchanging against a cooling stream, whereby said portion of the de-superheated hydrocarbon stream is at least partly condensed to form the pressurized and at least partially condensed mixture of hydrocarbons;

a de-superheater discharge conduit configured between the de-superheater system and the condenser, to establish a fluid connection between the de-superheater system and the condenser;

a compressor train surge recycle pathway arranged between the de-superheater discharge conduit and the suction scrubber inlet to convey a recycle flow of a recycle portion of the de-superheated hydrocarbon stream, at a recycle flow rate, from the de-superheater discharge conduit to the suction inlet of the train of one or more compressors via the compression suction scrubber;

a surge recycle valve configured in said compressor train surge recycle pathway, to control the recycle flow rate;

a surge recycle separator drum configured in said compressor train surge recycle pathway, and arranged to remove and drain liquid constituents from the recycle portion of the de-superheated hydrocarbon stream via a liquid drain outlet;

a liquid drain conduit fluidly connecting the liquid drain outlet of the surge recycle separator drum with the feed scrubber.

According to an embodiment, the de-superheater system comprises a de-superheater bypass line to selectively bypass the de-superheater heat exchanger, the de-superheater bypass line comprising a temperature controlled valve, and a temperature controller functionally coupled to the temperature-controlled valve to change a valve opening setting of the temperature controlled valve in response to a temperature of the de-superheated hydrocarbon stream in the de-superheater discharge conduit.

Controlling the recycle flow rate is done to maintain a flow rate through the train of one or more compressors to keep the train of one or more compressors from surging. This may for instance be done by known surge control techniques, such as including measuring the flow rate through the train of one or more compressors and monitoring the operation of the train of one or more compressors and controlling the recycle flow rate in response thereto.

Figure 2:
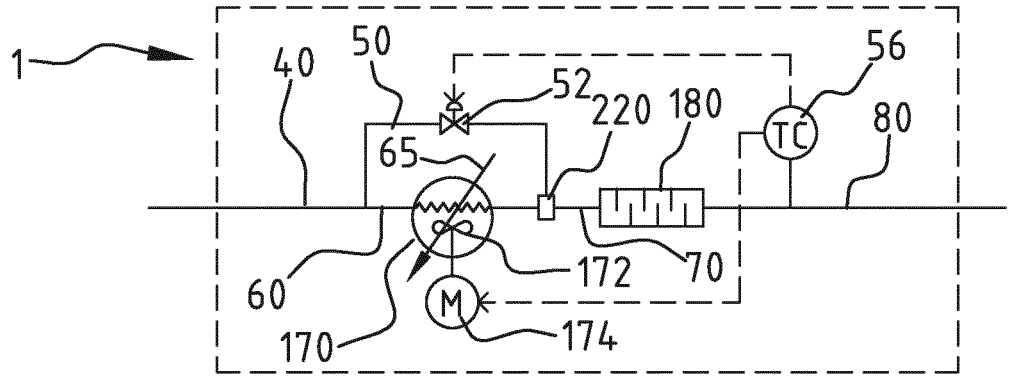
Figure 3:
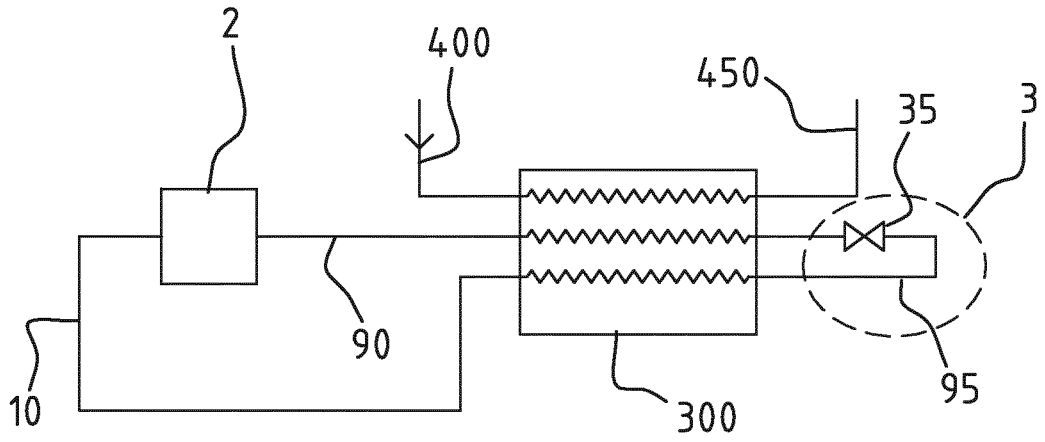
Figure 4:
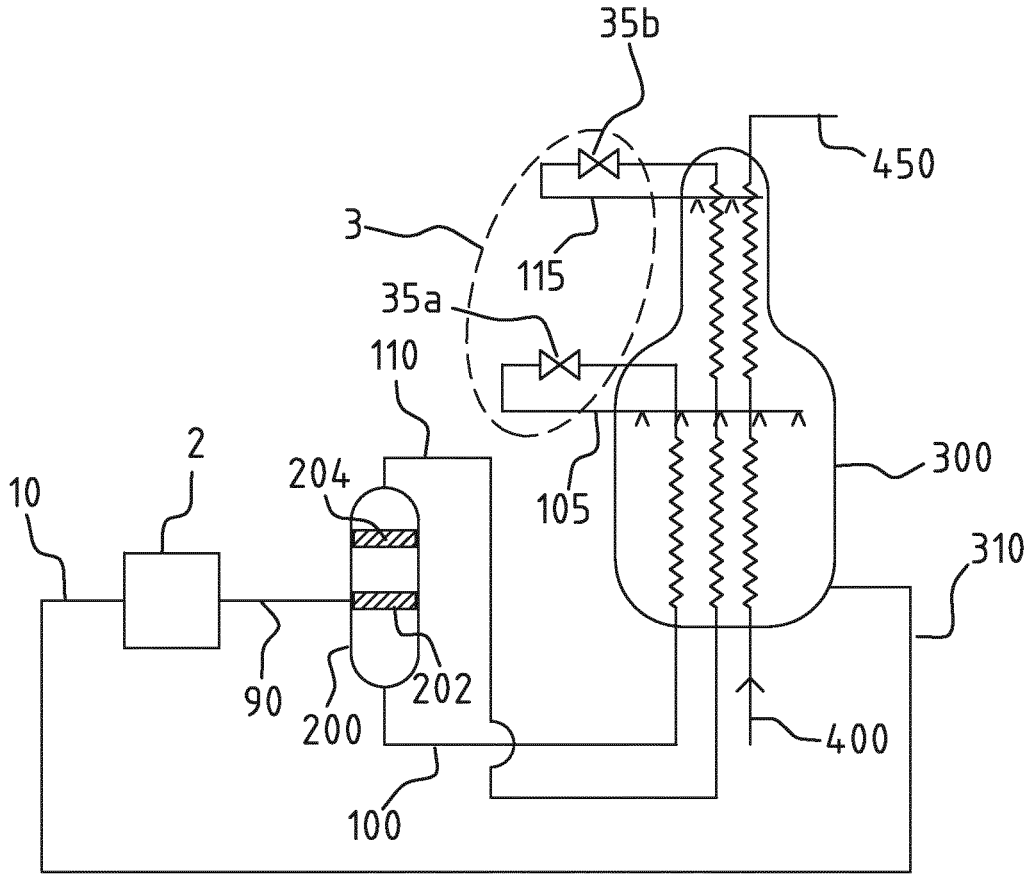

The invention will be further illustrated hereinafter by way of example only, and with reference to the non-limiting drawing in which;

FIG. 1 schematically shows a compression system for producing a pressurized and at least partially condensed mixture of hydrocarbons according to embodiments of the invention;

FIG. 2 schematically shows an alternative de-superheater system that may be employed in the compression system of FIG. 1;

FIG. 3 schematically shows a refrigeration system for refrigerating a product stream, which incorporates the compression system of FIG. 1; and FIG. 4 schematically shows an alternative refrigeration system for refrigerating a product stream, which also incorporates the compression system of FIG. 1.

For the purpose of this description, a single reference number will be assigned to a line as well as a stream carried in that line. Same reference numbers refer to similar components. The person skilled in the art will readily understand that, while the invention is illustrated making reference to one or more a specific combinations of features and measures, many of those features and measures are functionally independent from other features and measures such that they can be equally or similarly applied independently in other embodiments or combinations.

The present disclosure involves a compression system and method, for producing a pressurized and at least partially condensed mixture of hydrocarbons. A hydrocarbon stream in vapour phase is compressed in a train of one or more compressors. The compressed vaporous discharge stream from the train of one or more compressors is de-superheated in a de-superheater system, by indirect heat exchanging against an ambient stream. A surge recycle pathway is provided in the compression system along which a recycle portion from de-superheated hydrocarbon stream can be recycled to avoid compressor surge. It is presently proposed to configure a surge recycle separator drum a compressor train surge recycle pathway. This surge recycle separator drum is an additional vapour/liquid separator in addition to the usual compression suction scrubber, and the liquid constituents drained from the surge recycle separator drum are fed into a feed scrubber, which is also an additional scrubber upstream of the compression suction scrubber.

The compression suction scrubber, which is usually provided in compression systems, may not be able to handle the liquid load under all circumstances. Excess liquid constituents may be generated for instance if the ambient temperature is lower than minimum design temperature, or during start-up conditions. This facilitates the use of an ambient stream as the heat sink in the de-superheater heat exchanger, as the actual temperature of the ambient stream may fluctuate significantly over the seasons and the 24 hour cycle of each day.

Furthermore, employing the proposed compression system allows maintaining a de-superheated stream at a temperature much closer to the dew point temperature of the de-superheated stream being discharged from the de-superheater system, because if partial condensation occurs under exceptional circumstances the additional scrubber upstream of the compression suction scrubber will remove liquid constituents which will suitably be routed back to the feed scrubber.

The proposed compression system can be incorporated in a system for refrigerating a product stream, as will be illustrated herein below.

FIG. 1 illustrates one example of a compression system 2 for producing a pressurized and at least partially condensed mixture of hydrocarbons. The illustrated compression system 2 comprises a compression suction scrubber 160. The compression suction scrubber 160 suitably comprises a suction drum provided with at least a suction scrubber outlet 166 configured to discharge the vaporous compressor feed stream 30 from the compression suction scrubber 160. The compression suction scrubber 160 also comprises a suction scrubber inlet 162 provided in the suction drum.

The suction scrubber inlet 162 is connected to a feed line 10 via a feed scrubber 150. The feed scrubber 150 comprises a feed drum provided with at least a feed scrubber inlet 152 connected the feed line 10 to supply a feed vapour from a feed vapour source providing a mixture of hydrocarbons in vapour phase. The feed drum is also provided with a feed scrubber vapour outlet 156. The feed scrubber vapour outlet 156 is in fluid communication with the suction scrubber inlet 162.

The suction scrubber outlet 166 is in direct fluid communication with the train of one or more compressors. This train of one or more compressors is represented in FIG. 1 as a single compressor 230, which may consist of one or multiple compression stages optionally connected to each other with intercooling. However, the train of one or more compressors may also comprise a plurality of compressors connected in sequence with each other optionally with intercooling. Any intercooling may comprise additional suction drums to ensure that no liquid droplets or particulates can pass from the intercooling into the next compressor or compressor stage.

Regardless of the number of compressors or compression stages, the train of one or more compressors comprises 232 a suction inlet fluidly connected to the feed scrubber vapour outlet 166, as well as a compressor train discharge outlet 236.

The train of one or more compressors is configured to compress the vaporous compressor feed stream 30 from the compression suction scrubber 160 to a higher pressure, whereby forming the compressed vaporous discharge stream 40 at the discharge outlet 236.

The discharge outlet 236 is in fluid communication with a de-superheater system 1, which is configured to form a de-superheated hydrocarbon stream 80 out of the compressed vaporous discharge stream. The de-superheater system 1 comprises a de-superheater heat exchanger 170 arranged in fluid communication with the compressor train discharge outlet 236. The de-superheater heat exchanger 170 is arranged such that least a portion of the compressed vapour discharge stream 40 is brought in indirect heat exchanging contact with an ambient stream 65. At a downstream end the de-superheater system 1 is in fluid communication with a de-superheater discharge conduit 80 via which the final de-superheated hydrocarbon stream is discharged from the de-superheater system 1.

The de-superheater further comprises a temperature controller 56. The temperature controller 56 is functionally coupled to the temperature-controlled valve 52 to change a valve opening setting in response to a temperature of de-superheated stream in the de-superheater discharge conduit 80. The temperature controller 56 is programmed to keep the temperature of the de-superheated stream in the de-superheater discharge conduit 80 above a dew point temperature of the de-superheated stream in the de-superheater discharge conduit 80.

The temperature controller is preferably programmed to keep the temperature of the de-superheated hydrocarbon stream between 1° C. and 15° C. above said dew point temperature. More preferably, the temperature controller is programmed to keep the temperature of the de-superheated hydrocarbon stream between 1° C. and 10° C. above said dew point temperature. The most preferred target temperature for the temperature controller is (about) 5° C. above said dew point temperature.

The temperature controller 56 is suitably configured to regulate the heat transfer rate in the de-superheater heat exchanger 170, for instance by regulating the flow rate of the ambient stream 65 in the de-superheater heat exchanger 170. The ambient stream 65 may be a stream of ambient air at an actual temperature taken from the ambient air having the actual temperature which surrounds the compression system. In this case, regulating the flow rate of the ambient stream 65 in the de-superheater heat exchanger 170 may be accomplished by varying the speed of a fan 172 which drives the stream of ambient air through the de-superheater heat exchanger 170. The speed of the fan 172 may suitably be varied by varying the motor speed of motor 174 which drives the fan 172. However, alternatives have been conceived, including varying air inlet vanes. The first approach temperature in the de-superheater heat exchanger 170, between the actual temperature and the de-superheated hydrocarbon stream in the de-superheater discharge conduit 80, is suitably between 25° C. and 65° C.

A condenser 190 is arranged in fluid connection with the de-superheater system 1 via the de-superheater discharge conduit 80, which is configured between the de-superheater system 1 and the condenser 190, to receive at least a portion 85 of the de-superheated hydrocarbon stream 80. The condenser 190 is configured to further cool the portion of the de-superheated hydrocarbon stream 80, by allowing indirect heat exchanging against a cooling stream 165, whereby said portion 85 of the de-superheated hydrocarbon stream 80 is at least partly condensed to form a pressurized and at least partially condensed mixture of hydrocarbons 90. A second approach temperature, in the condenser 190, between the actual temperature and the pressurized and at least partially condensed mixture of hydrocarbons 90 is suitably between 1° C. and 10° C. Preferably, the second approach temperature is in a range of from 3° C. to 10° C., more preferably in a range of from 3° C. to 7° C. A typical optimum second approach temperature is 5° C. The second approach temperature is lower than the first approach temperature.

Suitably, the heat transfer rate in the condenser 190 is controlled by a temperature controller 196 on the at least partially condensed mixture of hydrocarbons 90. To this end, the flow rate of the ambient stream in the condenser 190 may be controlled via said temperature controller 196. In the case the ambient stream 165 is a stream of ambient air, this may be accomplished by varying the speed of fan 192 which drives the stream of ambient air through the condenser 190. The speed of the fan 192 may suitably be varied by varying the motor speed of motor 194 which drives the fan 192. However, alternatives have been conceived, including varying air inlet vanes.

In embodiments wherein both the de-superheater heat exchanger 170 and the condenser 190 are provided in the form of air-cooled heat exchangers, the de-superheater heat exchanger may be referred to as first air-cooled heat exchanger cooled by a first stream of ambient air, while the condenser may be referred to as second air-cooled heat exchanger cooled by a second stream of the ambient air.

A compressor train surge recycle pathway is arranged between the de-superheater discharge conduit 80 and the suction scrubber inlet 162. Herewith a recycle flow consisting of a recycle portion 120 of the de-superheated hydrocarbon stream, at a recycle flow rate, can be conveyed from the de-superheater discharge conduit 80 to the suction inlet 232 of the train of one or more compressors 230 via the compression suction scrubber 160.

A surge recycle valve 250 is configured in said compressor train surge recycle pathway, to control the recycle flow rate. A surge recycle separator drum 210 is configured in said compressor train surge recycle pathway in addition to the surge recycle valve 250. The surge recycle separator drum 210 is arranged to remove and drain liquid constituents from the recycle portion 120 of the de-superheated hydrocarbon stream via a liquid drain outlet 218 into a liquid drain conduit 140. The recycle vapour outlet 216 of the surge recycle separator drum 210 is fluidly connected with the compression suction scrubber 160 via the surge recycle valve 250 and suitably via the suction scrubber inlet 162 to allow vapour constituents of the recycle portion 120 to continue the journey along the compressor train surge recycle pathway and reach the suction scrubber inlet 162.

A drain control valve 240 may be provided in the liquid drain conduit 140 to control the flow rate of the liquid constituents being drained. Suitably the drain control valve 240 is controlled by a level controller 246 to keep the level of liquid constituents that has accumulated in the surge recycle separator drum 210 within a predetermined range.

The liquid drain outlet 218 of the surge recycle separator drum 210 is suitably fluidly connected via the liquid drain conduit 140 to the feed scrubber 150. The feed drum preferably comprises a liquid recycle inlet 154 as a separate inlet in addition to the feed scrubber inlet 152, whereby the liquid drain conduit fluidly connects the liquid drain outlet of the surge recycle separator drum 210 with the feed drum via the liquid recycle inlet 154. The liquid recycle inlet 154 is suitably configured gravitationally lower than the feed scrubber inlet 152.

The present invention is not limited by any specific de-superheater system 1. FIG. 1 illustrates an alternative de-superheater system 1 for de-superheating the compressed vaporous discharge stream 40. In addition to the de-superheater heat exchanger 170, the alternative de-superheater system 1 comprises a de-superheater bypass line 50 and a mixer 180. The de-superheater bypass line 50 comprises a temperature-controlled valve 52. This bypass line is configured to selectively bypass the de-superheater heat exchanger 170 over the temperature-controlled valve 52, with a bypass portion of the compressed vaporous discharge stream 40. The bypass portion typically is formed by the remainder of the compressed vaporous discharge stream 40 that is not fed to the de-superheater heat exchanger 170.

The alternative de-superheater system 1 further comprises a combiner 220, that is configured downstream of the de-superheater heat exchanger 170 for rejoining the bypass portion with the portion of the compressed vaporous discharge stream that has passed through the de-superheater heat exchanger 170. Together, these streams form a rejoined stream 70.

The temperature controller 56 in this alternative de-superheater system 1 is suitably functionally coupled to the temperature-controlled valve 52, to change a valve opening setting in response to a temperature of de-superheated stream in the de-superheater discharge conduit 80. The temperature controller 56 is programmed to keep the temperature of the de-superheated stream in the de-superheater discharge conduit 80 above a dew point temperature of the de-superheated stream in the de-superheater discharge conduit 80. Suitably, the heat transfer rate in the de-superheater heat exchanger 170 is controlled as well, possibly in concert the temperature-controlled valve 52. Controlling of the heat transfer rate in the de-superheater heat exchanger 170 has been described above.

The mixer 180 is configured downstream of the combiner 220, to receive and mix the rejoined stream 70, and to discharge the rejoined stream 70 into the de-superheater discharge conduit 80. An advantage of the mixer 180 is that if inadvertently some condensation may have occurred in the de-superheater heat exchanger 170, and small droplets or mist of liquid particulates are discharged from the de-superheater heat exchanger 170, the mixer facilitates the direct heat transfer between the bypass portion and the small droplets or mist of liquid particulates are discharged from the de-superheater heat exchanger 170 so that these can evaporate prior to being discharged in the de-superheater discharge conduit 80 in the form of the de-superheated stream. The mixer may suitably be provided in the form of a static mixer. Static mixers as such are known in the art, and they typically comprise a conduit defining a flow path for the rejoined stream 70, with static (stationary) flow-disrupting internals configured in the flow path. The advantage of a static mixer is that it functions autonomously because it contains no moving parts. Commercially available examples for various flow regimes are described in for instance an information brochure "Mixing and Reaction Technology" published by Sulzer Chemtech Ltd.

The compression system 2 may generally form part of such an industrial refrigeration processes of which examples will be described now with reference to FIGS. 3 and 4. Typically in such industrial refrigeration processes a hydrocarbon refrigerant is cycled in a refrigeration cycle. The feed line 10 is ultimately fed from the pressurized and at least partially condensed mixture of hydrocarbons 90.

In both FIG. 3 and FIG. 4, the feed vapour source comprises an expansion system 3. The expansion system 3 is configured to receive the pressurized and at least partially condensed hydrocarbon stream 90 from the condenser 190 in the compression system 2, and configured to expand the pressurized and at least partially condensed mixture of hydrocarbons whereby forming at least one refrigeration stream.

In the example of FIG. 3, the expansion system 3 comprises an expansion device 35. This expansion device 35 is for easy understanding illustrated in the form of a Joule-Thomson valve but it may be embodied in any suitable manner. For instance, the expansion device 35 may comprise an expansion turbine instead of or in combination with the Joule-Thomson valve.

The feed vapour source further comprises a cryogenic heat exchanger 300. The expansion system 3 is optionally separated from the compression system 2 by the cryogenic heat exchanger 300, configured to further cool the pressurized and at least partially condensed mixture of hydrocarbons prior to expanding it. However, this is not a requirement. The cryogenic heat exchanger 300 is arranged to receive the at least one refrigeration stream (95, in FIG. 3), and configured to allow the at least one refrigeration stream to pass. In addition, a product stream 400 is allowed to pass through the cryogenic heat exchanger 300, in an indirectly heat exchanging contact with the at least one refrigeration stream 95. The at least one refrigeration stream 95 absorbs heat from the product stream 400 during this indirect heat exchanging, whereby a phase transition occurs in the at least one refrigeration stream 95 from liquid phase to vapour phase. A discharge conduit 310 from the cryogenic heat exchanger 300 fluidly connects the cryogenic heat exchanger 300 with the feed line 10. This completes the vapour feed source.

The feed line 10, as described above, is connected to the compression system 2 via the feed scrubber 150.

In the example of FIG. 4, the compression system 2 for producing the pressurized and at least partially condensed mixture of hydrocarbons is connected to a gas/liquid phase separator 200, whereby the at least partially condensed mixture of hydrocarbons 90 is phase-separated in a liquid mixture of hydrocarbons 100 and a vaporous mixture of hydrocarbons 110. The gas/liquid phase separator 200 may be provided with internals to facilitate said phase-separating, including an inlet distributor 202 and a de-misting device 204. This refrigeration system is suitable if the at least partially condensed mixture of hydrocarbons is partially and not fully condensed. If the at least partially condensed mixture of hydrocarbons is fully condensed, this gas/liquid phase separator 200 is not necessary, such as illustrated in FIG. 3.

The expansion system 3 in FIG. 4 comprises two expansion devices 35*a* and 35*b*. Similar to expansion device 35 described above, each of expansion devices 35*a* and 35*b* may be embodied in any suitable manner. The expansion system 3 of FIG. 4 thus receives the pressurized and at least partially condensed hydrocarbon stream from the condenser in the form of two phase-separated streams corresponding the liquid mixture of hydrocarbons 100 and the vaporous mixture of hydrocarbons 110. The resulting refrigeration stream initially comprises an expanded heavy refrigerant fraction stream 105 and an expanded light refrigerant fraction stream 115. The cryogenic heat exchanger 300 is arranged to receive the expanded heavy refrigerant fraction stream 105 and expanded light refrigerant fraction stream 115, which streams are reunited within the cryogenic heat exchanger 300.

The expansion system 3 as shown in the example of FIG. 4 is separated from the compression system 2 by the cryogenic heat exchanger 300. Hence the cryogenic heat exchanger 300 is configured to further cool the pressurized and at least partially condensed mixture of hydrocarbons prior to expanding it. This way, the liquid mixture of hydrocarbons 100 can be sub-cooled by rejecting heat to the refrigeration stream that passes from the expansion system 3 through the cryogenic heat exchanger 300 to the discharge conduit 310. Similarly, the vaporous mixture of hydrocarbons 110 can be condensed and subsequently sub-cooled by rejecting heat to the refrigeration stream that passes from the expansion system 3 through the cryogenic heat exchanger 300 to the discharge conduit 310.

Regardless of the type of refrigeration system, the product stream 400 may be a hydrocarbon stream that for at least 80 mol. % consists of methane.

In operation, the compression system 2 may be used in a method of producing a pressurized and at least partially condensed mixture of hydrocarbons 90. A mixture of hydrocarbons in vapour phase is passed through the feed scrubber 150, whereby discharging a feed scrubber vapour 20 from the feed scrubber 150. The feed scrubber vapour being discharged from the feed scrubber 150 is then passed through the compression suction scrubber 160. A vaporous compressor feed stream 30 is discharged from the compression suction scrubber 160, and compressed to a higher pressure whereby forming the compressed vaporous discharge stream 40.

The vaporous compressor feed stream 30 and the compressed vaporous discharge stream 40 may comprise a mixture comprising two or more selected from N2, C1, C2, C3, C4, C5, whereby N2 denotes nitrogen, C1 denotes methane, C2 denotes ethane and/or ethylene, C3 denotes propane and/or propylene, C4 denotes i-butane and/or n-butane, and C5 denotes one or more of the pentanes, such as i-pentane and/or n-pentane. In one embodiment, between 20 and 80 mol. % consists of C2 and/or C3 of which at least 10 mol. % C3, and at least 20 mol. % consists of one or more selected from C1, C4, and C5. In another embodiment, between 20 and 60 mol. % consists of C1 and/or C2, supplemented with up to 20 mol. % of N2 and at least 20 mol. % selected from C3, C4, and C5. In all cases the total amount of N2, C1, C2, C3, C4, and C5 in the mixture is at least 98 mol. %, preferably at least 99 mol. %, of the total mixture, whereby the maximum amount of N2 is 20 mol. %. The pressure the compressed vaporous discharge stream 40 is suitably in pressure range of from 30 to 50 bara.

The compression typically adds heat (enthalpy) to the vaporous compressor feed stream such that the compressed vaporous discharge stream 40 thus formed is typically superheated by more than 60° C. above the dew point temperature of the compressed vaporous discharge stream as it is being discharged from the last compressor (or last compression stage) in the train of one or more compressors.

The compressed vaporous discharge stream 40 is then de-superheated in the de-superheater system 1, whereby a de-superheated hydrocarbon stream 80 is formed out of the compressed vaporous discharge stream 40. In the course of de-superheating, at least the portion 60 of the compressed vaporous discharge stream 40 is brought in indirect heat exchanging contact with the ambient stream 65 in the de-superheater heat exchanger 170. Hereby, heat is allowed to flow from the compressed vaporous discharge stream 40 to the ambient stream 65.

At least a portion, or a portion, of the de-superheated hydrocarbon stream 80 passes from the de-superheater system 1 to the condenser 190 via the de-superheater discharge conduit 80. The portion of the de-superheated hydrocarbon stream in the condenser 190 is further cooled by indirect heat exchanging said portion of the de-superheated hydrocarbon stream against the cooling stream 165. During the further cooling, the portion of the de-superheated hydrocarbon stream is at least partly condensed, to form the pressurized and at least partially condensed mixture of hydrocarbons 90. As stated above, the de-superheated hydrocarbon stream may be fully condensed or partially condensed in the condenser 190.

A recycle portion 120 is split off from the de-superheated hydrocarbon stream 80 in the de-superheater discharge conduit, to establish a recycle flow at a recycle flow rate from the de-superheater discharge conduit 80 to the train of one or more compressors. The recycle flow passes via the surge recycle separator drum 210, the surge recycle valve 250 and the compression suction scrubber 160. The recycle flow rate is controlled with the surge recycle valve 250. Typically the recycle flow rate is determined with the object to keep the train of one or more compressors from surging by ensuring there is sufficient flow rate through the train of one or more compressors.

Liquid constituents are removed and drained from the recycle portion of the de-superheated hydrocarbon stream via the liquid drain outlet 218 in the surge recycle separator drum 210. The liquid constituents drained from the recycle portion of the de-superheated hydrocarbon stream are then fed into the feed drum of the feed scrubber 150. The liquid constituents suitably vaporize in the feed drum. Inside the feed drum these liquid constituents are allowed to mix with the mixture of hydrocarbons in vapour phase. The liquid constituents re-vaporize in direct heat exchange with the mixture of hydrocarbons in vapour phase.

The method described above is preferably carried out surrounded by ambient air having an actual temperature. The ambient stream 65 may be a steam of the ambient air at the actual temperature. The cooling stream 165 in the condenser 190 may be a chilled stream at a temperature below the actual temperature, or a second ambient air stream at the actual temperature.

In the specific embodiment of FIG. 2, the de-superheater heat exchanger 170 is selectively bypassed over the temperature-controlled valve 52 with the bypass portion 50 of the compressed vaporous discharge stream 40. The bypass portion 50 is rejoined with the portion 60 of the compressed vaporous discharge stream 40 that has passed through the de-superheater heat exchanger 170, thereby forming the rejoined stream 70. The rejoined stream 70 is subsequently passed through the mixer 180. This way, the de-superheated hydrocarbon stream 80 is formed out of the compressed vaporous discharge stream 40. The temperature-controlled valve 52 is preferably controlled in response to a temperature of de-superheated hydrocarbon stream in the de-superheater discharge conduit 80. Preferably, the temperature of the de-superheated hydrocarbon stream 80 is kept above a dew point temperature of the de-superheated hydrocarbon stream in the de-superheater discharge conduit 80. The dew point temperature depends on composition of the de-superheated hydrocarbon stream and the pressure in the de-superheater discharge conduit 80. The temperature of the de-superheated hydrocarbon stream is preferably kept between 1° C. and 15° C., more preferably between 1° C. and 10° C., above the dew point temperature. If desired a larger safety margin may be applied, whereby the temperature of the de-superheated hydrocarbon stream is kept at least 2 or 3° C. above the dew point temperature instead of only 1° C. The optimum temperature of the de-superheated hydrocarbon stream is conceived to be 5° C. (or about 5° C.) above the dew point temperature. About 5° C. above the dew point temperature is understood to include temperatures between 3 and 7° C. above the dew point temperature.

In one example carried out in Honeywell UniSim™ process simulation software, a pressurized and at least partially condensed mixture of hydrocarbons 90 was produced using the method described above. The vaporous compressor feed stream 30 had the following composition:

| Components | Mol. % |
|---|---|
| N2 | 10.0 |
| C1 | 25.0 |
| C2 | 36.0 |
| C3 | 12.0 |
| C4 | 0.00 |
| C5 | 17.0 |

The resulting pressurized and at least partially condensed mixture of hydrocarbons 90, after compressing, de-superheating and partially condensing against an air stream having an actual temperature of 40° C., had a temperature of 45° C. and a pressure of 38.3 bara. A molar fraction of 0.76 was in vapour phase having an average molar mass of 28.67 g; a molar fraction of 0.24 was in liquid phase having an average molar mass of 52.84 g. This resulting pressurized and at least partially condensed mixture of hydrocarbons 90 was intended as refrigerant in a single mixed refrigerant process for liquefying a product stream of natural gas.

The method of producing a pressurized and at least partially condensed mixture of hydrocarbons 90 as described above may form part of a method of refrigerating a product stream. In such method of refrigerating, a mixture of hydrocarbons in vapour phase is obtained from the pressurized and at least partially condensed mixture of hydrocarbons 90 and passed to the compression suction scrubber 160. To this end, the the pressurized and at least partially condensed mixture of hydrocarbons 90 is expanded, whereby forming at least one refrigeration stream, such as but not limited to the refrigeration stream 95 in FIG. 3 or the expanded heavy refrigerant fraction stream 105 and the expanded light refrigerant fraction stream 115 of FIG. 4.

Regardless the precise nature of the at least one refrigeration stream, the at least one refrigeration stream is then passed through the cryogenic heat exchanger 300 where it is exposed to indirectly heat exchanging against the product stream. During this indirect heat exchanging, the at least one refrigeration stream absorbs heat from the product stream 400 whereby a phase transition occurs in the at least one refrigeration stream from liquid phase to vapour phase. The product stream 400 is thereby cooled and discharged from the cryogenic heat exchanger 300 as refrigerated product stream 450. Optionally, heat from the pressurized and at least partially condensed hydrocarbon stream 90 is simultaneously absorbed by the at least one refrigeration stream.

The at least one refrigeration stream is discharged in vapour phase from the cryogenic heat exchanger 300 in the form of the mixture of hydrocarbons in vapour phase.

The product stream may be a hydrocarbon stream that for at least 80 mol. % consists of methane. Examples of such a hydrocarbon stream include natural gas and pipeline gas from a natural gas grid. Synthetic gas Regardless of the precise nature of the product stream 400, during or after said indirectly heat exchanging the at least one refrigeration stream against the product stream 400 the product stream may be allowed to condense to form a liquefied hydrocarbon product stream. The liquefied hydrocarbon product stream may be a liquefied natural gas stream.

Although not shown in the drawings, a pressure reduction system may be arranged in the refrigerated product stream 450 downstream of the cryogenic heat exchanger 300 and in fluid communication therewith, to receive refrigerated product stream 450 and to reduce its pressure. An end-flash separator may be arranged downstream of the pressure reduction system, and in fluid communication therewith, to receive the refrigerated product stream from the pressure reduction system. The pressure reduction system may comprise a dynamic unit, such as an expander turbine, a static unit, such as a Joule Thomson valve, or a combination thereof. If an expander turbine is used, it may optionally be drivingly connected to a power generator. Many arrangements are possible and known to the person skilled in the art.

With these provisions it is possible to pass the product stream 400 through the cryogenic heat exchanger 300 in pressurized condition, for instance at a pressure of between 30 and 120 bar absolute, or between 30 and 80 bar absolute, while storing any liquefied part of the refrigerated product stream at substantially atmospheric pressure, such as between 1 and 2 bar absolute.

Depending on the separation requirements, the end flash separator may be provided in the form of a simple drum which separates vapour from liquid phases in a single equilibrium stage, or a more sophisticated vessel such as a distillation column. Non-limiting examples of possibilities are disclosed in U.S. Pat. Nos. 5,421,165; 5,893,274; 6,014,869; 6,105,391; and pre-grant publication US 2008/

0066492. In some of these examples, the more sophisticated vessel is connected to a reboiler whereby the refrigerated product stream 450, before being expanded in said pressure reduction system, is led to pass though a reboiler in indirect heat exchanging contact with a reboil stream from the vessel, whereby the refrigerated product stream 450 is caused to give off heat to the reboil stream.

The person skilled in the art will understand that the present invention can be carried out in many various ways without departing from the scope of the appended claims.

The invention claimed is:

1. A method of producing a pressurized and at least partially condensed mixture of hydrocarbons, comprising:

providing a mixture of hydrocarbons in vapor phase and passing said mixture of hydrocarbons through a feed scrubber comprising a feed drum thereby discharging a feed scrubber vapor from the feed scrubber;

passing the feed scrubber vapor from the feed scrubber through a compression suction scrubber comprising a suction drum thereby discharging a vaporous compressor feed stream from the compression suction scrubber;

compressing the vaporous compressor feed stream in a train of one or more compressors to a higher pressure thereby forming a compressed vaporous discharge stream;

de-superheating the compressed vaporous discharge stream in a de-superheater system comprising a de-superheater heat exchanger, comprising bringing at least a portion of the compressed vaporous discharge stream in indirect heat exchanging contact with an ambient stream in the de-superheater heat exchanger, thereby allowing heat to flow from the compressed vaporous discharge stream to the ambient stream, thereby forming a de-superheated hydrocarbon stream out of the compressed vaporous discharge stream;

passing at least a portion of the de-superheated hydrocarbon stream from the de-superheater system to a condenser via a de-superheater discharge conduit and further cooling the portion of the de-superheated hydrocarbon stream in said condenser by indirect heat exchanging said portion of the de-superheated hydrocarbon stream against a cooling stream, whereby said portion of the de-superheated hydrocarbon stream is at least partly condensed to form the pressurized and at least partially condensed mixture of hydrocarbons;

splitting off a recycle portion from the de-superheated hydrocarbon stream in the de-superheater discharge conduit and establishing a recycle flow at a recycle flow rate from the de-superheater discharge conduit to the train of one or more compressors via a surge recycle separator drum, a surge recycle valve, and the compression suction scrubber, a recycle vapor outlet of the surge recycle separator drum being fluidly connected with the compression suction scrubber, thereby controlling the recycle flow rate with the surge recycle valve and removing and draining liquid constituents from the recycle portion of the de-superheated hydrocarbon stream via a liquid drain outlet of the surge recycle separator drum;

feeding the liquid constituents drained from the recycle portion of the de-superheated hydrocarbon stream to the feed scrubber.

2. The method according to claim 1, the de-superheater system comprising a de-superheater bypass line to selectively bypass the de-superheater heat exchanger, the de-superheater bypass line comprising a temperature-controlled valve, and a temperature controller functionally coupled to the temperature-controlled valve, and the method comprising the step of changing a valve opening setting in response to a temperature of the de-superheated stream in the de-superheater discharge conduit.

3. The method of claim 1, wherein said providing a mixture of hydrocarbons in vapor phase further comprises:

expanding the pressurized and at least partially condensed mixture of hydrocarbons thereby forming at least one refrigeration stream;

passing the at least one refrigeration stream through a heat exchanger;

indirectly heat exchanging the at least one refrigeration stream against a product stream whereby the at least one refrigeration stream absorbs heat from the product stream and whereby a phase transition occurs in the at least one refrigeration stream from liquid phase to vapor phase;

discharging the at least one refrigeration stream in vapor phase from the heat exchanger in the form of the mixture of hydrocarbons in vapor phase.

4. The method of claim 3, wherein the product stream is a hydrocarbon stream that for at least 80 mol. % consists of methane, and wherein during said indirectly heat exchanging the at least one refrigeration stream against the product stream the product stream condenses to form a liquefied hydrocarbon product stream.

5. The method of claim 4, wherein the liquefied hydrocarbon product stream is a liquefied natural gas stream.

6. The method of claim 1, carried out surrounded by ambient air having an actual ambient temperature, wherein the ambient stream is a stream of the ambient air at the actual ambient temperature.

7. The method of claim 6, wherein said cooling stream is a second stream of the ambient air at the ambient temperature.

8. The method of claim 1, wherein said feed drum comprises at least a feed scrubber inlet and a liquid recycle inlet configured gravitationally lower than the feed scrubber inlet, wherein said mixture of hydrocarbons is passed through the feed scrubber via the feed scrubber inlet into the feed drum, and wherein the liquid constituents drained from the recycle portion of the de-superheated hydrocarbon stream are fed into the feed drum via said liquid recycle inlet.

9. The method of claim 1, wherein the liquid constituents that have been drained from the recycle portion of the de-superheated hydrocarbon stream vaporize in the feed drum.

10. A compression system for producing a pressurized and at least partially condensed mixture of hydrocarbons, comprising:

a feed scrubber comprising a feed drum provided with at least a feed scrubber inlet connected to a feed vapor source providing a mixture of hydrocarbons in vapor phase, and with a feed scrubber vapor outlet;

a compression suction scrubber comprising a suction drum provided with at least a suction scrubber inlet fluidly connected to the feed scrubber vapor outlet, and with a suction scrubber outlet configured to discharge a vaporous compressor feed stream from the compression suction scrubber;

a train of one or more compressors, comprising a suction inlet fluidly connected to the feed scrubber vapor outlet, and a compressor train discharge outlet, which train is configured to compress the vaporous compressor feed stream from the compression suction scrubber to a higher pressure thereby forming a compressed vaporous discharge stream at the discharge outlet;

a de-superheater system configured to form a de-superheated hydrocarbon stream out of the compressed vaporous discharge stream, said de-superheater system comprising a de-superheater heat exchanger arranged in fluid communication with the compressor train discharge outlet, wherein said de-superheater system is configured to bring at least a portion of the compressed vaporous discharge stream in indirect heat exchanging contact with an ambient stream in the de-superheater heat exchanger, thereby allowing heat to flow from the compressed vaporous discharge stream to the ambient stream;

a condenser arranged to receive at least a portion of the de-superheated hydrocarbon stream and configured to further cool the portion of the de-superheated hydrocarbon stream by allowing indirect heat exchanging against a cooling stream, whereby said portion of the de-superheated hydrocarbon stream is at least partly condensed to form the pressurized and at least partially condensed mixture of hydrocarbons;

a de-superheater discharge conduit configured between the de-superheater system and the condenser, to establish a fluid connection between the de-superheater system and the condenser;

a compressor train surge recycle pathway arranged between the de-superheater discharge conduit and the suction scrubber inlet to convey a recycle flow of a recycle portion of the de-superheated hydrocarbon stream, at a recycle flow rate, from the de-superheater discharge conduit to the suction inlet of the train of one or more compressors via the compression suction scrubber;

a surge recycle valve configured in said compressor train surge recycle pathway, to control the recycle flow rate;

a surge recycle separator drum configured in said compressor train surge recycle pathway, and arranged to remove and drain liquid constituents from the recycle portion of the de-superheated hydrocarbon stream via a liquid drain outlet, a recycle vapor outlet of the surge recycle separator drum being fluidly connected with the compression suction scrubber via the surge recycle valve; and a liquid drain conduit fluidly connecting the liquid drain outlet of the surge recycle separator drum with the feed scrubber.

11. The compression system of claim 10, wherein the de-superheater system comprises a de-superheater bypass line to selectively bypass the de-superheater heat exchanger, the de-superheater bypass line comprising a temperature controlled valve, and a temperature controller functionally coupled to the temperature-controlled valve to change a valve opening setting of the temperature controlled valve in response to a temperature of the de-superheated hydrocarbon stream in the de-superheater discharge conduit.

12. The compression system of claim 10, further comprising said feed vapor source, wherein said feed vapor source comprises:

an expansion system configured to receive the pressurized and at least partially condensed hydrocarbon stream from the condenser and configured to expand the pressurized and at least partially condensed mixture of hydrocarbons thereby forming at least one refrigeration stream;

a heat exchanger arranged to receive the at least one refrigeration stream configured to allow the at least one refrigeration stream to pass and a product stream to through in an indirectly heat exchanging contact with each other whereby the at least one refrigeration stream absorbs heat from the product stream and whereby a phase transition occurs in the at least one refrigeration stream from liquid phase to vapor phase;

a discharge conduit fluidly connecting the heat exchanger with the feed scrubber.

13. The compression system of claim 10, wherein the de-superheater heat exchanger is a first air-cooled heat exchanger and the ambient stream is a first stream of ambient air.

14. The compression system of claim 13, wherein the condenser is a second air-cooled heat exchanger wherein said cooling stream is a second stream of the ambient air.

15. The compression system of claim 10, wherein said feed drum comprises at least a feed scrubber inlet and a liquid recycle inlet configured gravitationally lower than the feed scrubber inlet, wherein said feed vapor source is connected to the feed drum via the feed scrubber inlet, and wherein the liquid drain conduit fluidly connects the liquid drain outlet of the surge recycle separator drum with the feed drum via said liquid recycle inlet.

* * * * *